US011378307B2

(12) United States Patent
Mirjalali

(10) Patent No.: US 11,378,307 B2
(45) Date of Patent: Jul. 5, 2022

(54) HYBRID CONDENSING BOILER WITH PREHEATER

(71) Applicant: Enerpro Inc., Cambridge (CA)

(72) Inventor: Seyed Jafar Mirjalali, Caledon (CA)

(73) Assignee: ENERPRO, Cambridge (CA)

( * ) Notice: Subject to any disclaimer, the term of this patent is extended or adjusted under 35 U.S.C. 154(b) by 72 days.

(21) Appl. No.: 16/536,692

(22) Filed: Aug. 9, 2019

(65) Prior Publication Data

US 2021/0041139 A1 Feb. 11, 2021

(51) Int. Cl.

| | |
|---|---|
| ***F24H 1/12*** | (2022.01) |
| ***F24H 1/14*** | (2022.01) |
| ***F24H 1/38*** | (2022.01) |
| ***F24H 1/18*** | (2022.01) |
| ***F24H 1/26*** | (2022.01) |
| ***F24H 1/20*** | (2022.01) |
| ***F24H 9/00*** | (2022.01) |

(52) U.S. Cl.

CPC ..... *F24H 1/125* (2013.01); *F24H 1/14* (2013.01); *F24H 1/181* (2013.01); *F24H 1/38* (2013.01); *F24H 1/206* (2013.01); *F24H 1/26* (2013.01); *F24H 9/0021* (2013.01)

(58) Field of Classification Search

CPC ... F24H 1/125; F24H 1/14; F24H 1/38; F24H 1/181; F24H 1/206; F24H 9/0021; F24H 1/08; F22B 23/04; F22B 21/34; F22B 17/18; F22B 21/088; F22B 25/00; F17C 2201/0152

See application file for complete search history.

(56) References Cited

U.S. PATENT DOCUMENTS

| | | | | | |
|---|---|---|---|---|---|
| 704,454 | A * | 7/1902 | Fergusson | F28D 7/106 | 165/154 |
| 2,708,914 | A * | 5/1955 | Cooper | F24H 9/124 | 122/19.1 |
| 3,528,582 | A * | 9/1970 | Rigollot | F17C 1/08 | 220/581 |
| 4,355,602 | A * | 10/1982 | Cooke | F22B 37/40 | 122/155.2 |
| 4,549,526 | A * | 10/1985 | Lunde | F23L 17/005 | 126/367.1 |
| 4,685,425 | A * | 8/1987 | Eising | F23J 15/06 | 122/18.3 |
| 5,365,887 | A * | 11/1994 | Fenn | F24H 1/145 | 122/155.2 |
| 6,817,319 | B1 * | 11/2004 | Manay | F22B 21/366 | 122/235.11 |
| 7,290,503 | B2 * | 11/2007 | Missoum | F24H 1/206 | 122/18.1 |

(Continued)

*Primary Examiner* — Michael G Hoang
*Assistant Examiner* — Andrew W Cheung
(74) *Attorney, Agent, or Firm* — Carlson, Gaskey & Olds, P.C.

(57) ABSTRACT

A boiler includes a tank, a gas circuit that includes a main combustion chamber in the tank and branch tubes in the tank that extend off of the main combustion chamber, and a water circuit fluidly isolated from the gas circuit. The water circuit includes a first manifold and water tubes that extend off of the first manifold. Each water tube extends through a respective one of the branch tubes, which may serve to preheat the water prior to discharge of the water into the tank.

20 Claims, 4 Drawing Sheets

(56) References Cited

U.S. PATENT DOCUMENTS

| | | | | |
|---|---|---|---|---|
| 7,334,542 | B2 * | 2/2008 | Zorzit | F22B 21/346 122/235.11 |
| 2010/0018475 | A1 * | 1/2010 | Arnold | F24H 1/206 122/18.1 |
| 2014/0305385 | A1 * | 10/2014 | Brown | F24H 1/32 122/18.31 |
| 2015/0241132 | A1 * | 8/2015 | Yanachi | F25B 40/00 165/154 |
| 2017/0211845 | A1 * | 7/2017 | Deal | F24H 8/00 |

* cited by examiner

HYBRID CONDENSING BOILER WITH PREHEATER

BACKGROUND

Boilers are known and used to heat water or create steam for various purposes. A typical boiler includes a tank in which the water is heated. A burner may provide hot combustion gases that are used to heat the water. For example, some boilers are configured as "fire tube" designs in which the combustion gases are provided through tubes inside the tank that heat water in the tank. Other types of boilers are configured as "water tube" designs in which the water is provided through tubes and the combustion gases are provided to heat water in the tubes.

SUMMARY

A boiler according to an example of the present disclosure includes a tank, a gas circuit that has a main combustion chamber in the tank and branch tubes in the tank that extend off of the main combustion chamber, and a water circuit fluidly isolated from the gas circuit and including a first manifold and water tubes extending off of the first manifold. Each water tube extends through a respective one of the branch tubes.

A further embodiment of any of the foregoing embodiments includes a second manifold connected with the water tubes and water output tubes that extend off of the second manifold. Each water output tube has an outlet end opening to the interior of the tank.

In a further embodiment of any of the foregoing embodiments, the outlet ends at located at the bottom of the tank.

A further embodiment of any of the foregoing embodiments includes fins disposed inside of the branch tubes.

In a further embodiment of any of the foregoing embodiments, the first manifold is outside of the tank.

In a further embodiment of any of the foregoing embodiments, the main combustion chamber is U-shaped.

In a further embodiment of any of the foregoing embodiments, main combustion chamber is closed-ended.

In a further embodiment of any of the foregoing embodiments, the tank has domed top and bottom caps.

In a further embodiment of any of the foregoing embodiments, the tank has a lobed cross-sectional shape.

A boiler according to an example of the present disclosure includes a tank, a gas circuit that has a main combustion chamber in the tank, a water circuit fluidly isolated from the gas circuit having first and second manifolds outside of the tank at, respectively, first and second opposed ends of the tank, and water tubes extending through the tank. Each water tube has an inlet at the first manifold and an outlet at the second manifold. Water output tubes extend off of the second manifold and into the tank. Each water output tube has an outlet end in the tank, and at least one tank outlet at the top of the tank.

In a further embodiment of any of the foregoing embodiments, the gas circuit includes branch tubes in the tank extending off of the main combustion chamber.

In a further embodiment of any of the foregoing embodiments, each water tube extends through a respective one of the branch tubes.

A further embodiment of any of the foregoing embodiments includes fins disposed inside of the branch tubes.

In a further embodiment of any of the foregoing embodiments, the main combustion chamber is U-shaped.

In a further embodiment of any of the foregoing embodiments, the main combustion chamber is closed-ended.

In a further embodiment of any of the foregoing embodiments, the tank has domed top and bottom caps.

In a further embodiment of any of the foregoing embodiments, the tank has a lobed cross-sectional shape.

A boiler according to an example of the present disclosure includes a tank, a gas circuit that has a main combustion chamber in the tank to transfer thermal energy to water in the tank and branch tubes in the tank that extend off of the main combustion chamber to also transfer thermal energy to water in the tank, and a water circuit fluidly isolated from the gas circuit and that has first and second manifolds outside of the tank at, respectively, first and second opposed ends of the tank. The water tubes extend through the tank. Each water tube has an inlet at the first manifold and an outlet at the second manifold, and each water tube extends through a respective one of the branch tubes such that water in the water tube is preheated prior to being discharged into the tank. Water output tubes extend off of the second manifold and into the tank. Each water output tube has an outlet in the tank, and at least one tank outlet at the top of the tank.

A further embodiment of any of the foregoing embodiments includes fins disposed inside of the branch tubes, and wherein the main combustion chamber is U-shaped, the main combustion chamber is closed-ended, the tank has domed top and bottom caps, and the tank has a lobed cross-sectional shape.

BRIEF DESCRIPTION OF THE DRAWINGS

The various features and advantages of the present disclosure will become apparent to those skilled in the art from the following detailed description. The drawings that accompany the detailed description can be briefly described as follows.

DETAILED DESCRIPTION

Figure 1A:
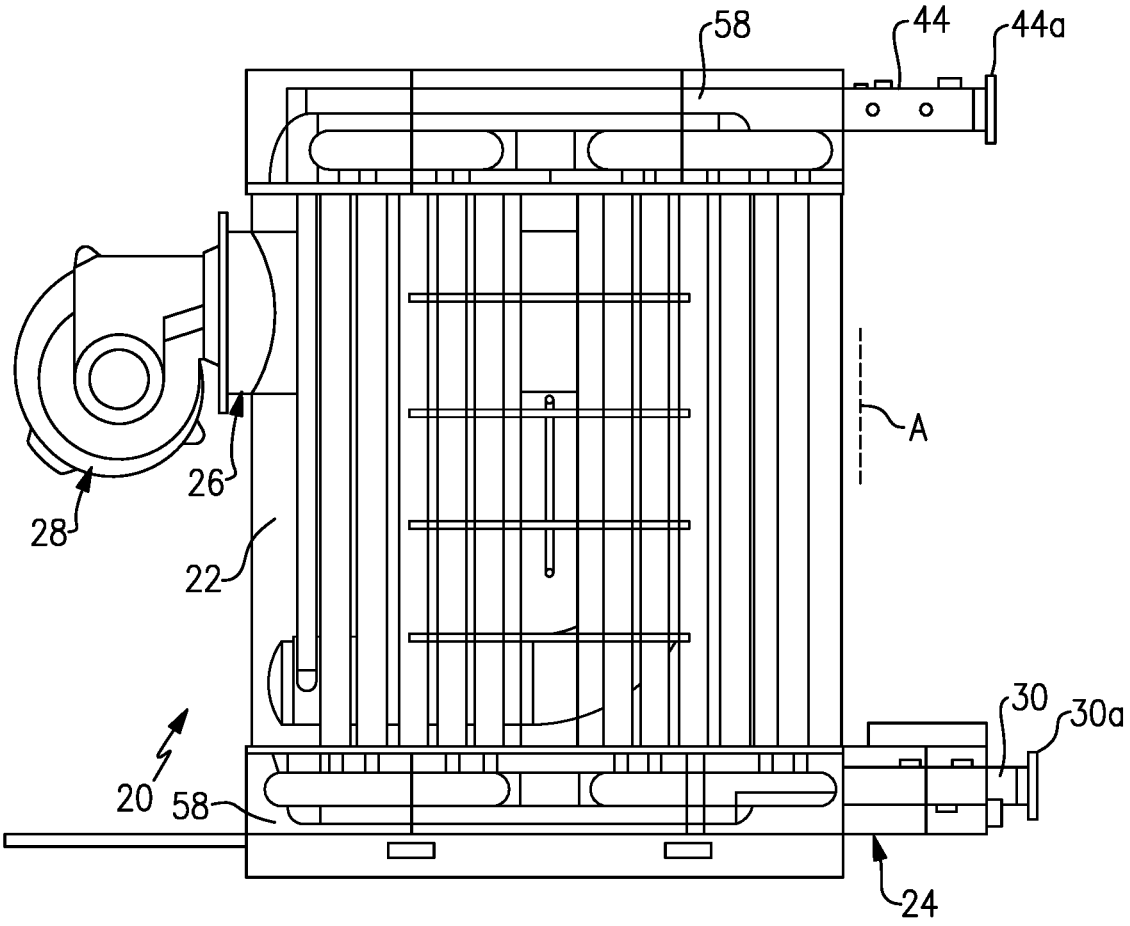
FIG. 1A illustrates a side view of an example boiler.
Figure 1B:
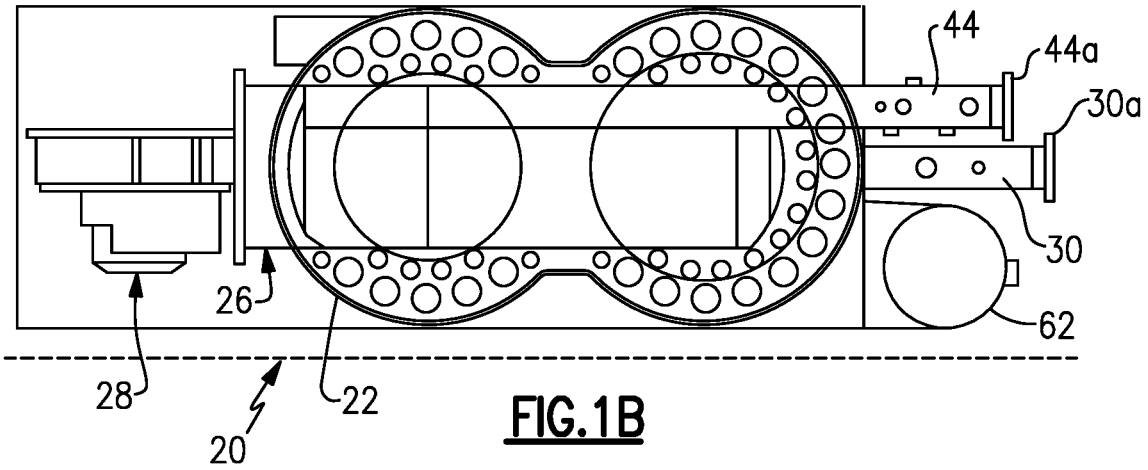
FIG. 1B illustrates a top-down view of the boiler.

FIG. 1A illustrates a side view of an example boiler 20, and FIG. 1B illustrates a top-down view of the boiler 20. The boiler 20 is generally operable to heat water or create steam and, in this regard, may be used as a water heater, pool heater, or any other application in which boilers are used. The boiler 20 is presented to demonstrate various features. However, although example features may be demonstrated together in combination, it is to be appreciated that the features may alternatively be used in other combinations that may exclude one or more of the features or include additional conventional features.

Figure 2A:
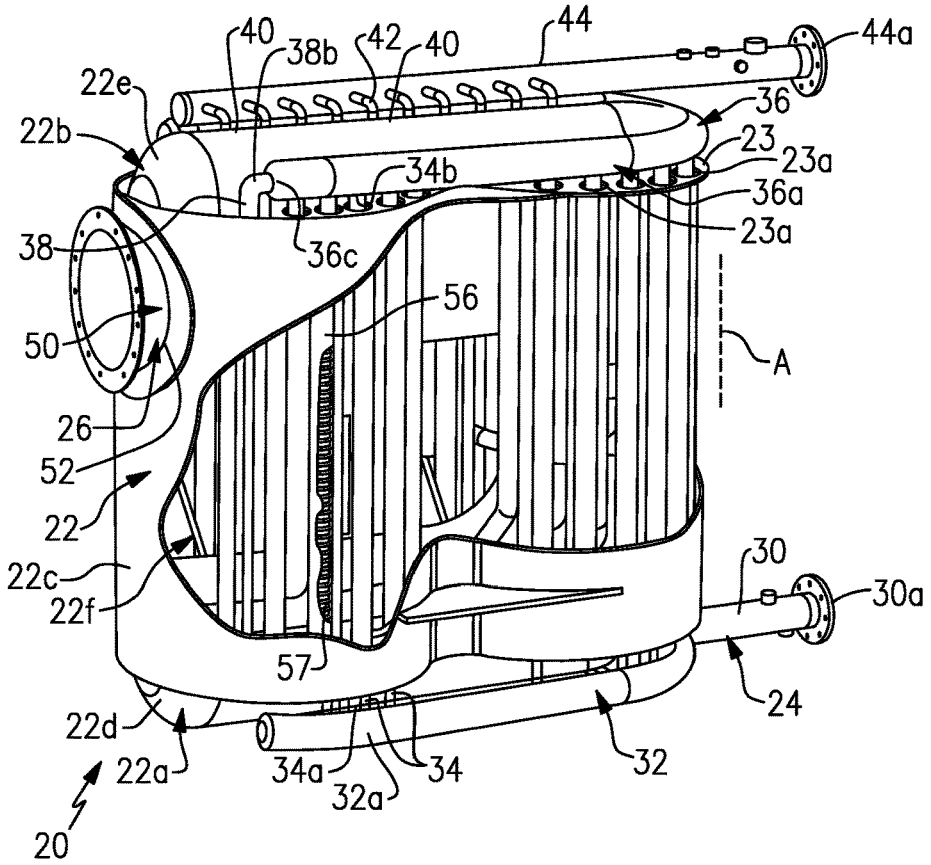
FIG. 2A illustrates a view of the boiler with a portion of the tank cutaway.
Figure 2B:
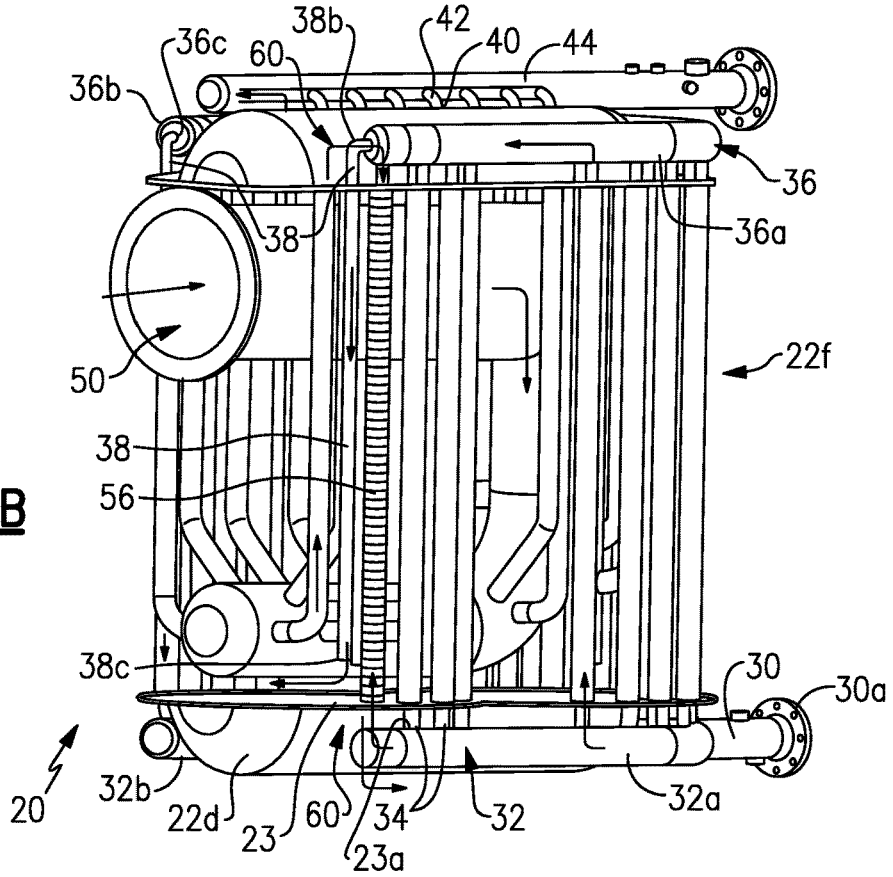
FIG. 2B illustrates a view of the boiler without the tank.
Figure 3:
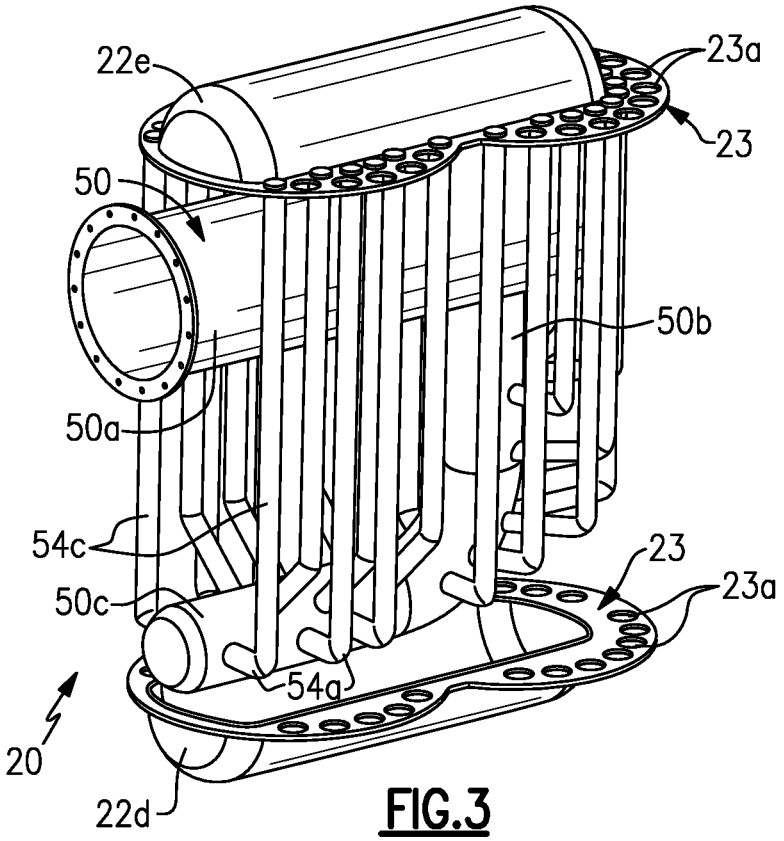
FIG. 3 illustrates a view of the boiler without the tank and a portion of the (branch tube) hot gas circuit.

FIG. 2A illustrates a partial cutaway view of selected portions of the boiler 20. In general, the boiler 20 includes a tank 22, a water circuit 24, and a gas circuit 26. The boiler 20 is also shown in FIG. 2B, but without the tank 22. The tank 22 is a closed vessel that includes a first end 22*a* and an opposed second end 22*b*. For example, the tank 22, as well as all of the components of the boiler 20 described below, may be composed of stainless steel or other material that is corrosion resistant under conditions that are typical of boilers. In the illustrated example, the first end 22*a* is the bottom of the tank 22 and the second end 22*b* is the top of the tank 22. For instance, the tank 22 is defined by a tank side wall 22*c* and first and second (bottom and top) domed end caps 22*d*/22*e* that are sealed with the side wall 22*c*. Together, the side wall 22*c* and end caps 22*d*/22*e* define a hollow interior 22*f*. FIG. 3 illustrates another view of the boiler 20, but without the side wall 22*c* and without portions of the water circuit 24. For purposes that will be discussed herein below, each of the caps 22*d*/22*e* includes a respective flange 23 that defines a plurality of through-holes 23*a*. The through-holes 23*a* may be of the same diametric size or of different sizes, depending on the size of the tubes extending therein.

The water circuit 24 circulates water and the gas circuit 26 circulates hot combustion gases from a burner 28 (FIG. 1A). The water circuit 24 and the gas circuit 26 are fluidly isolated from each other such that the water and the combustion gases do not mix or even come into direct contact.

The water circuit 24 includes an inlet pipe 30, which may be outfitted with a flange 30*a* or other type of fitting for attaching the boiler 20 to a water source. As an example, the inlet pipe 30 is the sole or exclusive inlet for water into the boiler 20.

The water circuit 24 further includes a first manifold 32, which is connected to the inlet pipe 30. In this example, the first manifold 32 is generally U-shaped or "8" shaped and may be formed of a single piece or multiple pieces. The first manifold 32 includes first and second legs 32*a*/32*b* (see FIG. 2B) that straddle the first end cap 22*d*. The first manifold 32 is generally horizontally oriented and the legs 32*a*/32*b* are elongated in the horizontal direction. The inlet pipe 30 opens into the first manifold 32 at the bottom of the "U" such that water entering the first manifold 32 from the inlet pipe 30 is generally equally divided to flow into both legs 32*a*/32*b*.

The water circuit 24 additionally includes water tubes 34 that extend off of the first manifold 32. For instance, the water tubes 34 include inlets 34*a* that open on the top of the first manifold 32 such that the water tubes 34 extend substantially vertically from the first manifold 32. As an example, a first group of the water tubes 34 extend off of the first leg 32*a* and a second group of the water tubes 34 extend off of the second leg 32*b*. The legs 32*a*/32*b* of the first manifold 32 are closed-ended such that water provided into the first manifold 32 must flow into the water tubes 34.

The water tubes 34 extend vertically from the first manifold 32 through the through-holes 23*a* of the flange 23 of the first end cap 22*d* (FIG. 2B). As shown in FIG. 2A, the water tubes 34 extend into and through the tank 22 and then through the through-holes 23*a* of the flange 23 of the second end cap 22*e*. The water tubes 34 then connect to a second manifold 36 that is located adjacent the second end 22*b* of the tank 22, i.e., adjacent the second end cap 22*e*.

Similar to the first manifold 32, the second manifold 36 is also generally U-shaped or "8 shaped and may be formed of a single piece or multiple pieces. The second manifold 36 includes first and second legs 36*a*/36*b* (see FIG. 2B) that straddle the second end cap 22*e*. The second manifold 36 is generally horizontally oriented and the legs 36*a*/36*b* are elongated in the horizontal direction. The water tubes 34 include outlets 34*b* that open on the bottom of the second manifold 36. Unlike the legs 32*a*/32*b* of the first manifold 32, the legs 36*a*/36*b* of the second manifold 36 have openings 36*c* at the ends and sides for injecting water into the tank 22, and openings on the bottom for receiving the water tubes 34.

The openings 36*c* are connected to water outlet tubes 38 that thereby extend off of the second manifold 36. The water outlet tubes 38 include an outlet section 38*b* coming out of the second manifold 36 and a substantially vertical section of the water outlet tube 38 that extends through another one of the through holes 23*a* of the flange 23 and into the tank 22 (FIG. 2B). As shown in FIG. 2B, the water outlet tube 38 (one shown) extends substantially the entire vertical length of the tank 22 to a location that is adjacent the first end cap 22*d*, i.e., the bottom of the tank 22. At its terminal end, the water outlet tube 38 has an outlet 38*c* that opens to the interior of the tank 22. The outlet 38*c* does not bottom-out on the bottom of the tank 22, but rather extends to a location that is near the bottom. In general, this location will be in at least the bottom 25% of the height of the tank 22, but more preferably in the bottom 15% or 10%.

The second end cap 22*e* further includes one or more openings 40 for discharging water. For example, the openings 40 are connected to discharge tubes 42, which are connected to a discharge manifold 44. As an example, the discharge manifold 44 may be a pipe that is outfitted with a flange 44*a* or other type of fitting for attaching the boiler 20 to a downstream device or use. The water circuit 24 may thus include any or all of the structures described above though which water flows.

The gas circuit 26 includes structures that combustion gases flow through in the boiler 20. In this regard, the gas circuit 26 may include a main combustion chamber 50 (see FIGS. 2A, 2B, and 3). As best shown in FIG. 3, the main combustion chamber 50 is generally U-shaped and includes a first leg 50*a*, a turn section 50*b*, and a second leg 50*c*. The "U" is oriented sideways such that the legs 50*a*/50*c* are generally horizontally oriented, while the turn section 50*b* is generally vertically oriented. The first leg 50*a* includes an opening that is connected to the burner 28. The first leg 50*a* extends through an opening 52 in the tank 22 (FIG. 2A) into the interior of the tank 22. Beyond the opening 52, the entirety of the main combustion chamber 50 is within the tank 22.

The gas circuit 26 may further include branch tubes 54 that extend off of the main combustion chamber 50. For instance, in the illustrated example, all of the branch tubes 54 extend off of the lower portion of the turn section 50*b* and the second leg 50*c* of the main combustion chamber 50.

The branch tubes 54 include elbows 54*a* that provide a turn from generally horizontal sections of the branch tubes 54 coming out of the main combustion chamber 50 and substantially vertical sections of the branch tubes 54 that extend upwards through the tank 22 and the through holes 23*a* in the flange 23 of the second end cap 22*e*. The elbows 54*a* permit the branch tubes 54 to extend upwards rather than further in the horizontal lateral direction, which facilitates a reduction in the footprint of the boiler 20. Additionally, the elbows 54*a* provide compliance to permit thermal expansion of the branch tubes 54. In general, the is one group of branch tubes 54 that all extend off of one side of the main combustion chamber 50 (toward the leg 32*a*) and another group of branch tubes 54 that extend off of the opposed side of the main combustion chamber 50 (towards the legs 32*b*).

The branch tubes 54 are interrupted at the through-holes 23*a* or just beyond the through-holes 23*a* such that the vertically upward-extending sections of the branch tubes 54 terminate. Additional downwardly-extending branch tubes 56 begin at other ones of the holes 23*a* in the flange 23 of the second end cap 22*e*. The branch tubes 56 extend downwards through the tank 22 to the through-holes 23*a* in the flange 23 of the first end cap 22*d*. The branch tubes 56 terminate at the through-holes 23*a* or just beyond the through-holes 23*a*. Enclosures 58 (see FIG. 1A) may be provided around each of the end caps 22*d*/22*e* such that there are gas transfer spaces 60 below and above the first and second end caps 22*d*/22*e*, respectively, into which the branch tubes 54/56 open. Thus, combustion gases are discharged from the branch tubes 54 into the space 60 above the second end cap 22*e*. The gases are subsequently drawn into the branch tubes 56 from the space 60 via a downstream draft pressure differential. If desired, elbow connectors could instead be used to directly connect the tubes 54/56 rather than discharging the gas into the space 60.

The branch tubes 56 terminate at the same through-holes 23*a* in the flange 23 of the first end cap 22*d* which the water tubes 34 extend through such that inside of the tank 22 the water tubes 34 are disposed inside of the branch tubes 56. For instance, each water tube 34 is concentrically arranged in a corresponding one of the branch tubes 56. The branch tubes 56 are of larger diameter than the water tubes 34 such that there is an annular gas passage between the outer diameter surface of the water tube 34 and the inner diameter surface of the branch tube 56 for flow of the combustion gases. As shown in FIG. 2A, there may be fins 57 disposed inside of the branch tubes 56 to provide additional surface area through which to transfer thermal energy to the water in the water tubes 34. The fins 57 are generally thin ridges or projections that either wrap/spiral around the water tubes 34 from top to bottom as a group or individually or that extend linearly betwee the water tubes and the inner diameter of the branch tubes 56.

The burner 28 produces hot combustion gas that is blown or otherwise provided into the main combustion chamber 50. The combustion gas travels from the main combustion chamber 50 into the branch tubes 54. The branch tubes 54 open into the gas transfer space 60 above the second end cap 22*e*. From there, the gas travels into the branch tubes 56 and then into the gas transfer space 60 below the first end cap 22*d*. The gas may then be exhausted from the boiler 20 through an exhaust structure 62 (FIG. 1B) and/or chimney.

During operation of the boiler 20 to heat water, water is initially provided in the water circuit 24 through the inlet pipe 30 and into the first manifold 32. The water then travels vertically upwards through the water tubes 34 inside of the tank 22 to the second manifold 36, and then to the water outlet tubes 38, which discharge the water into the interior of the tank 22. Thus, water is not directly provided into the tank, but rather first travels through the water tubes 34 inside the tank 22.

The burner 28 provides hot combustion gases into the main combustion chamber 50, which then flow through the branch tubes 54/56 as described above. The thermal energy from the gases in the main combustion chamber 50 and branch tubes 54/56 serves to conductively and radiantly heat the water in the tank 22 that is in contact with the outer surfaces of the main combustion chamber 50 and the outer surfaces of the branch tubes 54/56. Additionally, the hot gases that flow through the branch tubes 56, in which the water tubes 34 are disposed, transfer thermal energy to the water flowing in the water tubes 34. The fins 57 facilitate such heat transfer. The water entering the boiler 20 is thus preheated in the water transfer tubes 34 by the hot gases in the branch tubes 56 prior to being discharged from the water outlet tubes 38 into the interior of the tank 22. The branch tubes 56 thereby serve the dual purpose of heating the water in the tank and preheating the water in the water tubes 34. In particular, the preheating avoids directly feeding source water, which may initially be cold, into the tank 22. This facilitates a reduction in thermal shock to hot components in the boiler 20, such as the main combustion chamber 50 and branch tubes 54, which come into contact with the water in the interior of the tank 22, i.e., the temperature difference between the components and the water is less than it would otherwise be without such preheating.

The water outlet tubes 38 provide additional convective heating. For instance, since the water outlet tubes 38 open at the bottom of the tank 22 and the water is discharged from the top of the tank 22, the discharge of water from the water outlet tubes 38 serves to circulate the water in the tank 22, thereby churning cooler water that may settle toward the bottom of the tank 22 and pushing the water toward the top of the tank 22. The churning and mixing of the water may thus facilitate the reduction of water stagnation and steam while promoting convective heating.

As can be appreciated, the water can cause an elevation in pressure inside of the tank 22. In this regard, a further feature of the boiler 20 to accommodate such pressures is that the end caps 22*d*/22*e* are domed (FIG. 3). The domed shape, which may be hemi-cylindrical or near hemi-cylindrical serves to uniformly distribute pressure across the end caps 22*d*/22*e*. For example, the end caps 22*d*/22*e* may be formed of relatively thin tube sheets, such as stainless steel tube sheets. The domed shape also permits compliance when under pressure or under thermal expansion, thereby also facilitating a mitigation of pressure/stress on other components, such as the main combustion chamber 50 and branch tubes 54/56.

Figure 4:
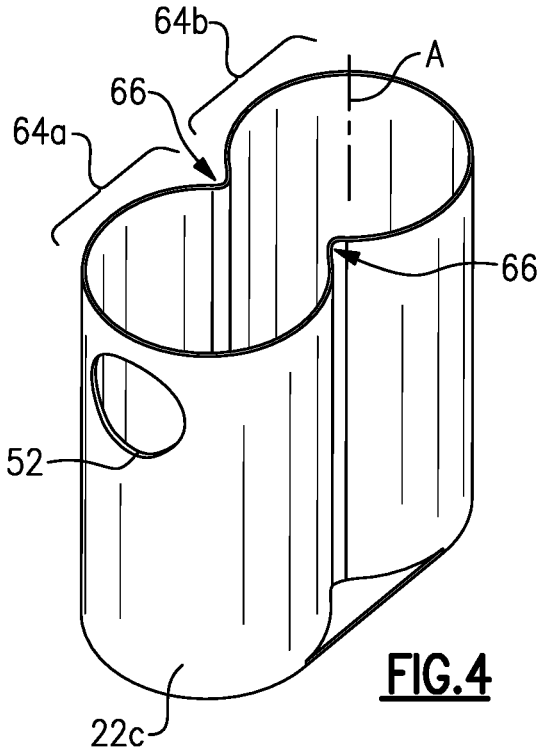
FIG. 4 illustrates an isolated view of a portion of the tank.

The configuration of the main combustion chamber 50, branch tubes 54/56, manifolds 32/36, and water tubes 34 also serves to reduce the footprint of the boiler 20. For instance, the boiler 20 as a relatively compact footprint because the tubes 34/54/56 are oriented substantially vertically rather than horizontally, which is enabled by the U-shaped configurations of the manifolds 32/36 and main combustion chamber 50. In this regard, as shown in an isolated view of the side wall 22*c* of the tank 22 in FIG. 4, the side wall 22*c* has a lobed cross-sectional shape (in a plane that is perpendicular to vertical direction A). For instance, the side wall 22*c* defines a first lobe 64*a* and a second lobe 64*b* that meet at junctions 66. For instance, the lobes 64*a*/64*b* may be symmetrical about a horizontal axis that intersects the junctions 66.

The junctions 66 projects inwards such that the narrowest portion of the profile of the side wall 22*c* is between the junctions 66. In the boiler 20, the junctions 66 project toward the center of the boiler 20 and between adjacent ones of the branch tubes 56. Such a lobed-shape further facilitates the reduction in the size the footprint of the boiler 20, while also reducing weight.

Figure 5:
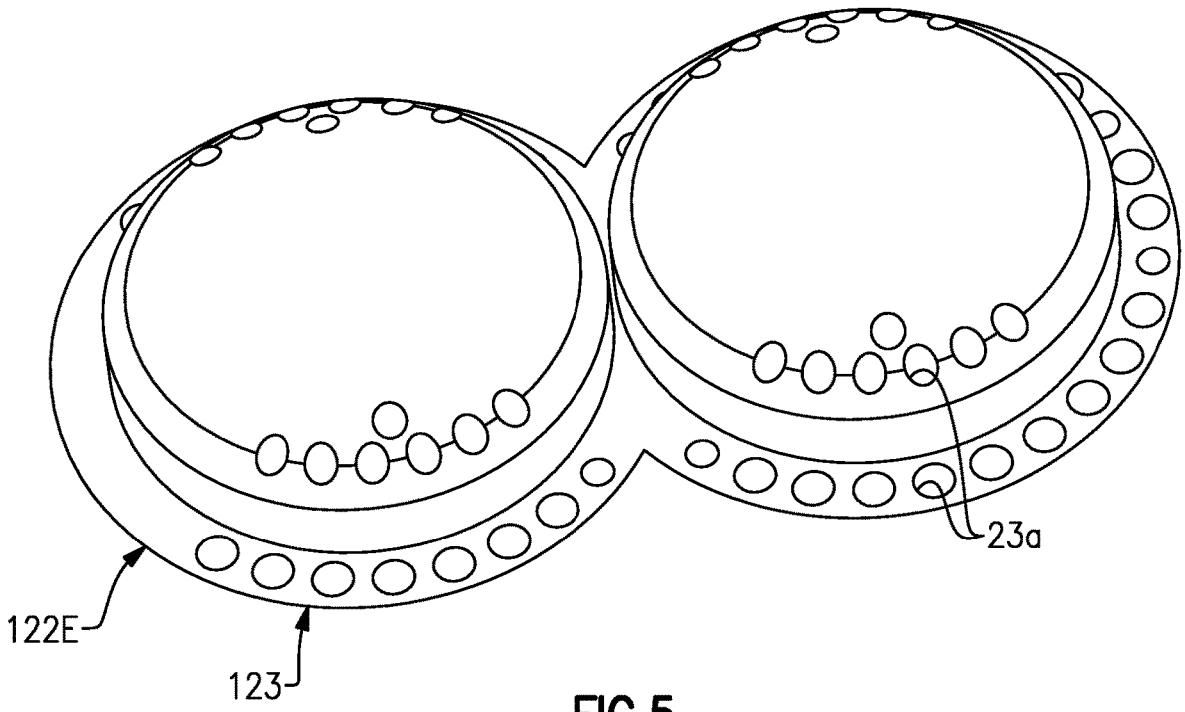
FIG. 5 illustrates an alternate example of an end cap.

FIG. 3 illustrates an example of the end cap 22*e* that has a cylindrical dome. FIG. 5 illustrates an alternate example of an end cap 122*e* in which, rather than the cylindrical dome, the end cap 122*e* has two circular domes. Additionally, in the end cap 22*e*, the openings 23*a* are exclusively in the flange 23. In the end cap 122*e*, however, a some of the openings 123*a* are in the circular domes.

Although a combination of features is shown in the illustrated examples, not all of them need to be combined to realize the benefits of various embodiments of this disclosure. In other words, a system designed according to an embodiment of this disclosure will not necessarily include all of the features shown in any one of the Figures or all of the portions schematically shown in the Figures. Moreover, selected features of one example embodiment may be combined with selected features of other example embodiments.

The preceding description is exemplary rather than limiting in nature. Variations and modifications to the disclosed examples may become apparent to those skilled in the art that do not necessarily depart from this disclosure. The scope of legal protection given to this disclosure can only be determined by studying the following claims.

What is claimed is:

1. A boiler comprising:

a tank configured to contain water;

a gas circuit including, a U-shaped main combustion chamber in the tank with a horizontally oriented first leg, a vertically oriented turn section, and a horizontally oriented second leg positioned below the first leg, and branch tubes in the tank extending off of the turn section and the second leg of the main combustion chamber; and a water circuit fluidly isolated from the gas circuit and including a first manifold and water tubes extending off of the first manifold, each said water tube extending through a respective one of the branch tubes.

2. The boiler as recited in claim 1, further comprising a second manifold connected with the water tubes and water output tubes extending off of the second manifold, each said water output tube having an outlet end opening to the interior of the tank.

3. The boiler as recited in claim 2, wherein the outlet ends are located at the bottom of the tank.

4. The boiler as recited in claim 1, further comprising fins disposed inside of the branch tubes.

5. The boiler as recited in claim 1, wherein the first manifold is outside of the tank.

6. The boiler as recited in claim 1, wherein the main combustion chamber is closed-ended.

7. The boiler as recited in claim 1, wherein the tank has domed top and bottom caps.

8. The boiler as recited in claim 1, wherein the tank has a lobed cross-sectional shape with a first lobe and second lobe that meet at junctions projecting towards the center of the tank.

9. A boiler comprising:

a tank configured to contain water;

a gas circuit including a main combustion chamber in the tank;

a water circuit fluidly isolated from the gas circuit and including, first and second manifolds outside of the tank at, respectively, first and second opposed ends of the tank, a first and second group of water tubes extending through the tank, each said water tube having an inlet at the first manifold and an outlet at the second manifold, water output tubes extending off of the second manifold and into the tank, each said water output tube having an outlet end in the tank, and at least one tank outlet at the top of the tank;

wherein the main combustion chamber is positioned between the first and second group of water tubes.

10. The boiler as recited in claim 9, wherein the gas circuit includes a first and second group of branch tubes in the tank extending off of opposed sides of the main combustion chamber.

11. The boiler as recited in claim 10, wherein each of said first group of water tubes extends through a respective one of the first group of branch tubes and each of said second group of water tubes extends through a respective one of the second group of branch tubes.

12. The boiler as recited in claim 11, wherein the main combustion chamber is closed-ended.

13. The boiler as recited in claim 11, wherein the tank has a lobed cross-sectional shape with a first lobe and second lobe that meet at junctions projecting towards the center of the tank.

14. A boiler comprising:

a tank configured to contain water;

a gas circuit including, a U-shaped main combustion chamber in the tank to transfer thermal energy to water in the tank with a horizontally oriented first leg, a vertically oriented turn section, and a horizontally oriented second leg positioned below the first leg, and a first and second group of branch tubes in the tank extending off opposed sides of the turn section and the second leg of the main combustion chamber to also transfer thermal energy to water in the tank;

a water circuit fluidly isolated from the gas circuit and including, first and second manifolds outside of the tank at, respectively, first and second opposed ends of the tank, a first and second group of water tubes extending through the tank, each said water tube having an inlet at the first manifold and an outlet at the second manifold, and each of said first group of water tubes extending through a respective one of the first group of branch tubes and each of said second group of water tubes extending through a respective one of the second group of branch tubes such that the main combustion chamber is positioned between the first and second group of water tubes and such that water in the water tubes is preheated prior to being discharged into the tank;

water output tubes extending off of the second manifold and into the tank, each said water output tube having an outlet in the tank, and at least one tank outlet at the top of the tank.

15. The boiler as recited in claim 14, further comprising fins disposed inside of the branch tubes, and wherein:

the main combustion chamber is closed-ended, each branch tube includes an elbow that provides a turn from a generally horizontal section coming out of the main combustion chamber and a substantially vertical section that extends upwards through the tank, the first manifold is U-shaped with a first and second leg, the first group of water tubes extending off of the first leg of the first manifold and the second group of water tubes extending off of the second leg of the first manifold, the second manifold is U-shaped with a first and second leg, the first group of water tubes having an outlet in the first leg of the second manifold, the second group of water tubes having an outlet in the second leg of the second manifold and the water output tubes extending off the end of the first and second legs of the second manifold, the outlet ends of the water output tubes are at locations in the bottom 25% of the height of the tank, the tank has domed top and bottom caps, and the tank has a lobed cross-sectional shape with a first lobe and second lobe that meet at junctions projecting towards the center of the tank.

16. The boiler as recited in claim 1, wherein each branch tube includes an elbow that provides a turn from a generally horizontal section coming out of the main combustion chamber and a substantially vertical section that extends upwards through the tank.

17. The boiler as recited in claim 9, wherein the first manifold is U-shaped with a first and second leg, the first group of water tubes extending off of the first leg of the first manifold and the second group of water tubes extending off of the second leg of the first manifold.

18. The boiler as recited in claim 17, wherein the second manifold is U-shaped with a first and second leg, the first group of water tubes having an outlet in the first leg of the second manifold, the second group of water tubes having an outlet in the second leg of the second manifold, and the water output tubes extending off the end of the first and second legs of the second manifold.

19. The boiler as recited in claim 9, wherein the outlet ends of the water output tubes are at locations in the bottom 25% of the height of the tank.

20. The boiler as recited in claim 9, wherein the outlet ends of the water output tubes are at locations in the bottom 15% of the height of the tank.

* * * * *